US007347244B2

(12) United States Patent
Vaillancourt

(10) Patent No.: US 7,347,244 B2
(45) Date of Patent: Mar. 25, 2008

(54) MEMBRANE APPLICATOR

(76) Inventor: Pierre Vaillancourt, 5521 Winston Park Blvd., North, Apt. 108, Coconut Creek, FL (US) 33073

( * ) Notice: Subject to any disclaimer, the term of this patent is extended or adjusted under 35 U.S.C. 154(b) by 331 days.

(21) Appl. No.: 11/012,099

(22) Filed: Dec. 16, 2004

(65) Prior Publication Data

US 2006/0037710 A1 Feb. 23, 2006

(30) Foreign Application Priority Data

Aug. 17, 2004 (CA) ..... 2478785

(51) Int. Cl.
*E04D 15/06* (2006.01)
*E04D 5/00* (2006.01)

(52) U.S. Cl. ..... 156/497; 156/71; 156/499; 156/577; 156/579; 226/15; 492/27

(58) Field of Classification Search ..... 156/71, 156/574, 577, 579, 497, 499; 492/27; 226/15, 226/17
See application file for complete search history.

(56) References Cited

U.S. PATENT DOCUMENTS 3,093,936 A * 6/1963 Figge ..... 156/359
3,962,016 A * 6/1976 Alfter et al. ..... 156/304.3
4,725,328 A * 2/1988 Arnold ..... 156/380.9
4,872,246 A * 10/1989 Yano ..... 492/16
5,439,540 A * 8/1995 Lippman et al. ..... 156/71
6,155,321 A 12/2000 Bindschedler et al.
6,484,781 B2 * 11/2002 Weaver ..... 156/577
6,588,475 B1 * 7/2003 Simon et al. ..... 156/359
6,892,977 B2 * 5/2005 Boone et al. ..... 242/595.1
2005/0028941 A1 * 2/2005 Flowers ..... 156/574

* cited by examiner

*Primary Examiner*—Mark A. Osele
(74) *Attorney, Agent, or Firm*—Ogilvy Renault LLP

(57) ABSTRACT

A membrane applicator comprises a wheeled carriage adapted to ride on a surface to be covered with the membrane. A roll mount system is provided on the carriage to support a roll of membrane thereon. A press roll is mounted to the carriage for pressing the membrane against the surface to be covered as the membrane is being unrolled from said roll mount system as a result of a displacement of the carriage on the surface. The applicator is particularly well suited for applying bituminous membrane on flat roof surfaces of commercial and industrial buildings.

16 Claims, 6 Drawing Sheets

MEMBRANE APPLICATOR

BACKGROUND OF THE INVENTION

1. Field of the Invention

The present invention relates to membrane applicators and, more particularly, to an apparatus suited for applying bitumen rolls on roof structures.

2. Description of the Prior Art

Bituminous roofing membranes are typically torch-applied. The roofer holds a torch in his hands and swept the torch across the back side of an unrolled length of bituminous membrane to cause the membrane to adhere to the underlying flat (or low pitch) roof decking surface. In addition to the torch welder, at least two other operators are needed to properly unroll and aligned the membranes in order to provide for uniform and constant longitudinal lap joints along the sides of adjacent laid down membranes. This process is labour intensive and the quality of the membrane installation varies greatly according to the skills and the attention of the operators. Also, this work is physically demanding and often results in injuries. It would thus be beneficial to limit the human intervention in the application of roof membranes.

This problem has been addressed by Flame Engineering Inc who has developed a bitumen membrane applicator known as the "Red Dragon Modified Bitumen Applicator MBA-800". The applicator comprises a wheeled carriage supporting a bottom roll mount system and a series of propane torches for heating the entire width of the roll while the carriage is being displaced over the deck surface to be covered. One problem associated with such an applicator is that the distance between the torches and the roll or the BTU output must be continuously readjusted to compensate for the reduction of the diameter of the roll as the membrane is being unrolled. If the distance between the roll and the torches is not re-adjusted the portion of the membrane at the end of the roll will be located at a greater distance from the heat source and will thus be less heated, thereby resulting in undesirable variation in the fusion process of the membrane on the deck surface. The Red Dragon applicator also lacks any means for ensuring that the membrane is properly aligned while being applied. Furthermore, the Red Dragon applicator does not provide any means for covering the excess melted bitumen squeezed out from the sides of the membrane while the same is being applied onto the roof surface. This implies that another individual has to pass after the torch welder to cover with granules the excess molten bitumen that has swept out from the sides of the membrane. Furthermore, a gas hose extends between the Red Dragon carriage and the propane tank, which remains in a fixed position on the deck while the applicator is being displaced thereover. This gas hose is cumbersome and constitutes a further obstacle that has to be contoured or displaced by the operator drawing the red dragon applicator over the deck.

SUMMARY OF THE INVENTION

It is therefore an aim of the present invention to provide a new membrane applicator which addresses the above mentioned issues.

Therefore, in accordance with the present invention, there is provided an apparatus for applying a membrane to a substantially flat surface, the membrane having a front side and an adherent back side; the apparatus comprising a wheeled carriage adapted to ride on the surface to be covered with the membrane, a roll mount system provided on said carriage to support a roll of membrane on said carriage, and a press roll mounted to said carriage and engageable with the front side of the membrane to press the back side thereof against the surface to be covered as the membrane is being unrolled from said roll mount system as a result of a displacement of said carriage on the surface.

In accordance with a further aspect of the present invention, there is provided a roofing apparatus for applying rolls of roofing membranes to substantially flat roof surfaces, the roofing apparatus comprising a wheeled frame steerable over the roof surface upon which the roofing membrane is to be laid down, a roll mount adapted to support one roll of roofing membrane on said wheeled carriage at a distance from the roofing surface, and a press roll carried by said wheeled frame and adapted to ride on the roofing surface to press the membrane against the roof surface.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
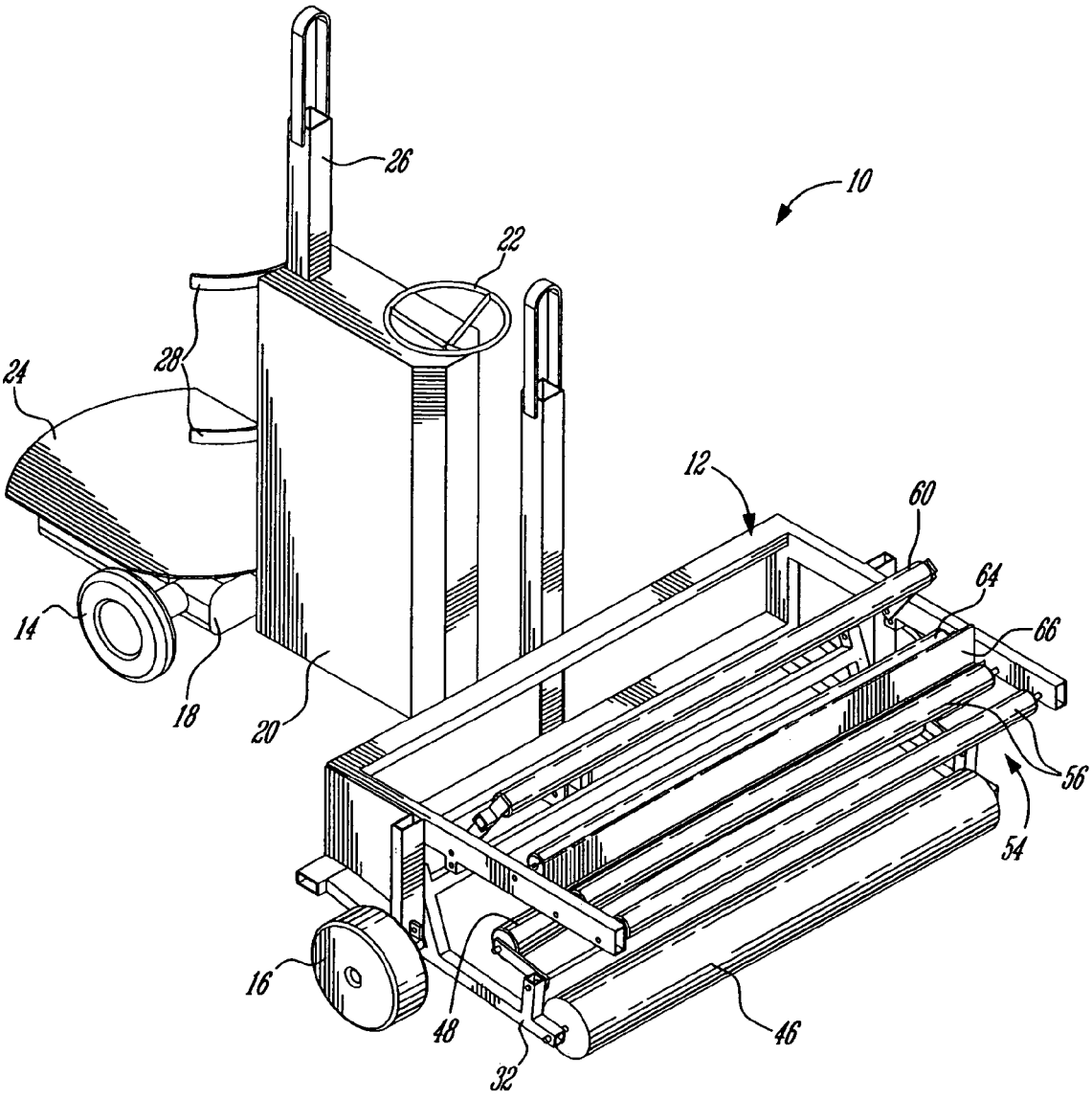
FIG. 1 is a first perspective view of a membrane applicator in accordance with an embodiment of the present invention, some parts of the applicator being omitted for clarity.

Now referring to the drawings, and in particular to FIGS. 1 and 2, a membrane applicator embodying the elements of the present invention and generally designated by the numeral 10 will be described. The membrane applicator 10 is particularly suited for applying roofing membranes, such as elastomer membranes and bituminous membranes, on substantially flat roof decking surfaces. However, it is understood that the membrane applicator 10 is not limited to roofing applications and could be used to apply other types of membrane on other surfaces as well.

Figure 2:
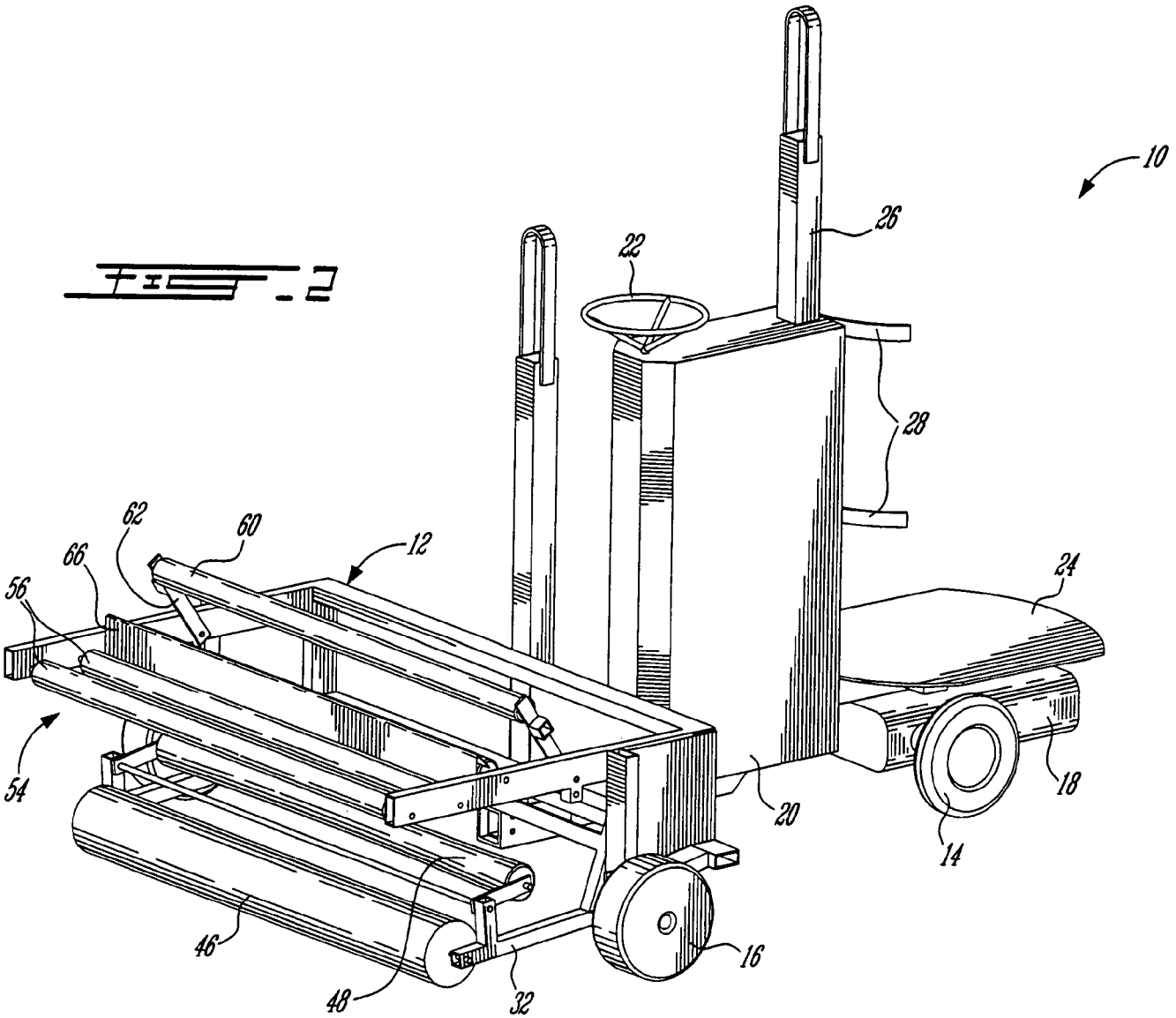
FIG. 2 is a second perspective view of the membrane applicator shown in FIG. 1, some parts of the applicator being omitted for clarity.

As shown in FIGS. 1 and 2, the membrane applicator 10 generally comprises a carriage having a wheeled frame 12 including front and rear wheels 14 and 16. The front wheels 14 are preferably power driven by a motor 18 powered by a battery (not shown) housed in a metal casing 20. A conventional steering system including a steering wheel 22 is provided for allowing the operator to steer the front wheels 14. A platform 24 and a vertical support 26 are provided at the front of the wheeled frame 12 for removably receiving a propane tank (not shown). Vertically spaced-apart arcuate retaining members 28 are provided along the vertical support 26 for hugging the propane tank. Standard attachments (for instance strap and buckle arrangements) are preferably associated with the arcuate members 28 to tightly encircle the propane tank and thus releasably secure the same on the platform 24.

Figure 4:
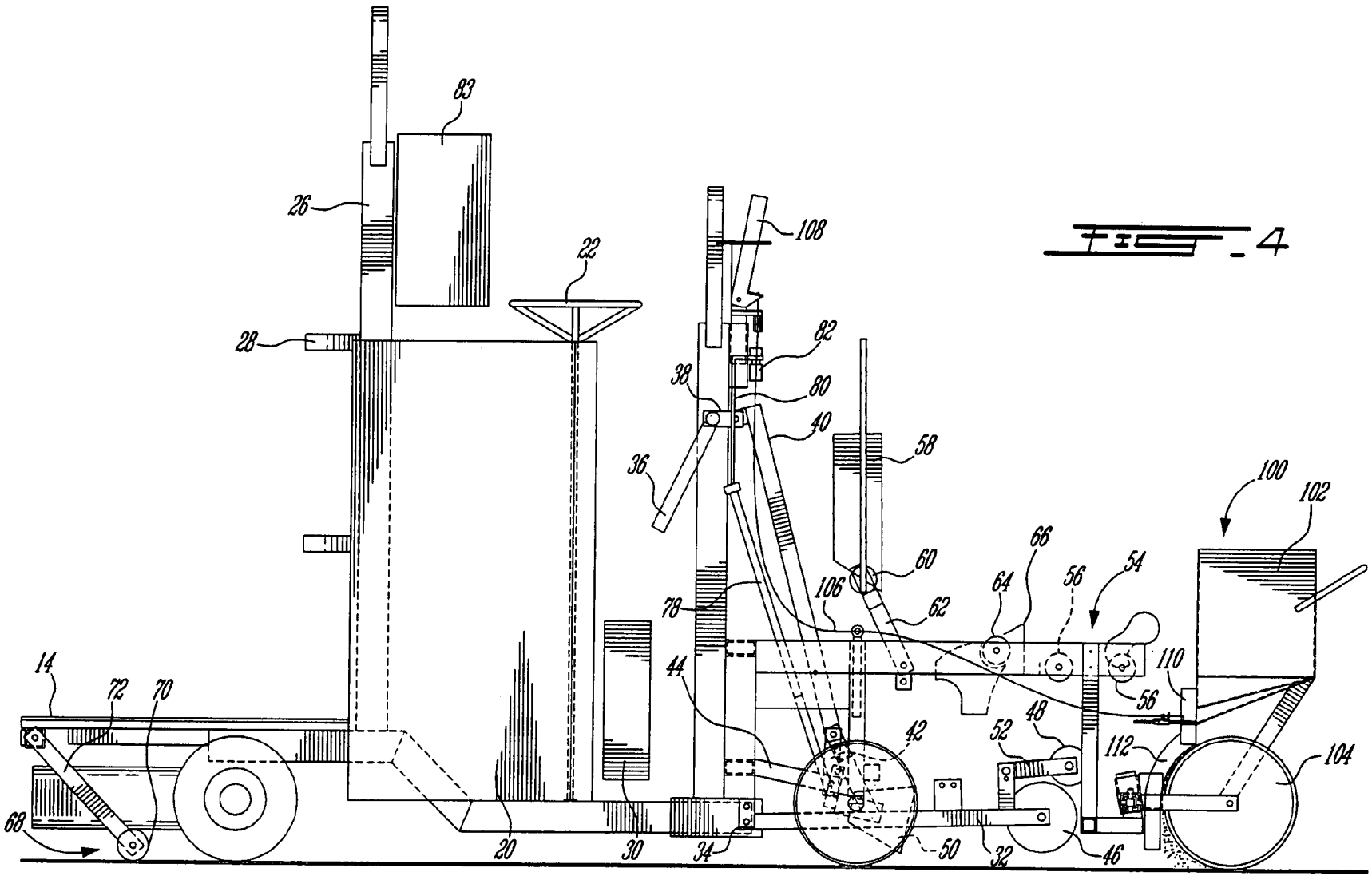
FIG. 4 is a side elevation view of the membrane applicator shown in a position ready to receive a new roll of membrane.

As shown in FIG. 4, a fire extinguisher 30 is preferably mounted to the frame 12 at the rear of the metal casing 20. The operator stands up on the carriage at that particular location behind the metal casing 20.

Figure 5:
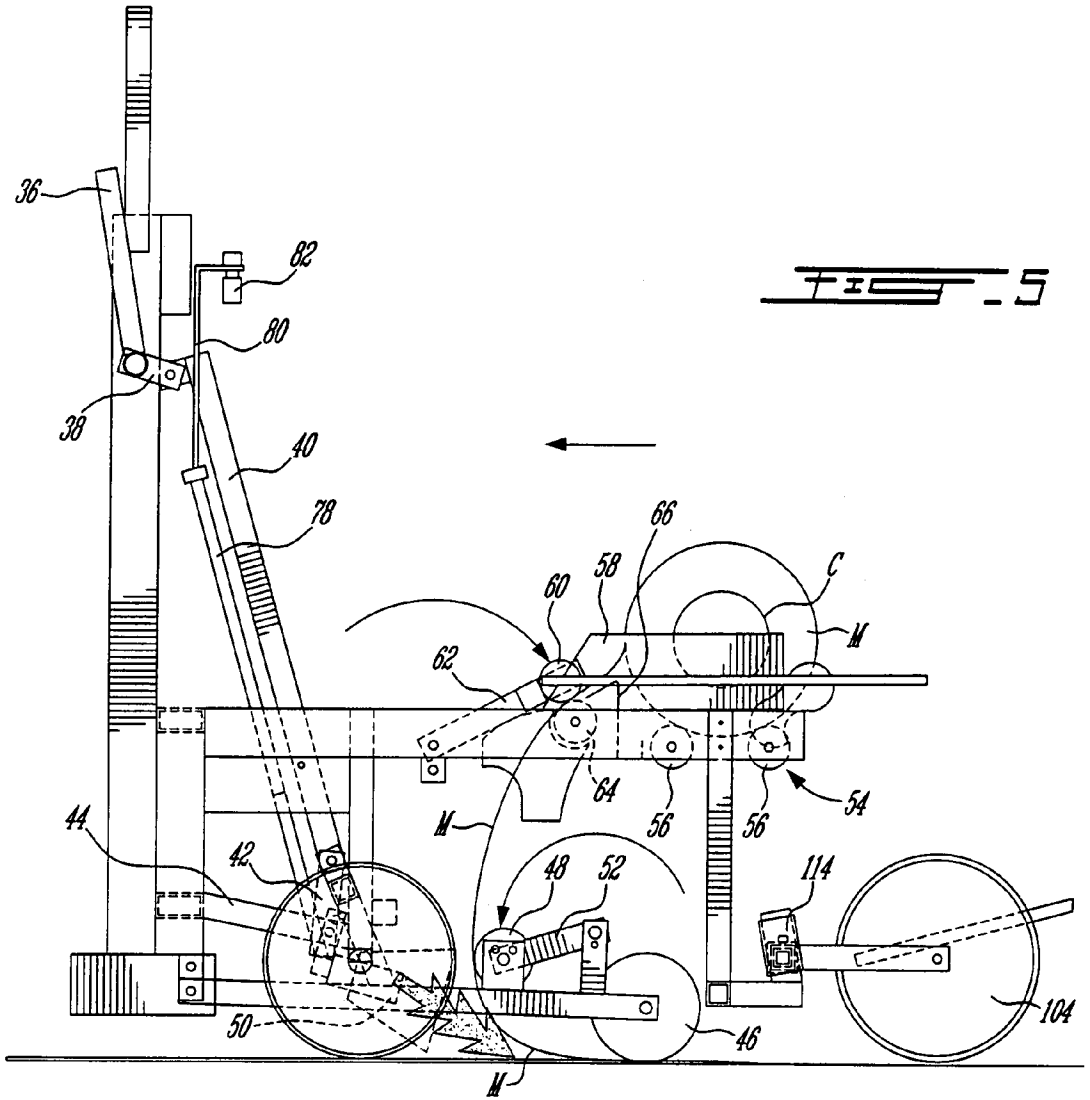
FIG. 5, is a side elevation view of the membrane application shown in the process of applying a membrane on a deck surface.

The rear portion of the frame 12 comprises a sub-frame assembly 32 pivotable about a pivot point 34 between a raised position (FIG. 4) and a lowered position (FIG. 5). A control lever 36 can be pivoted between a raised position (FIG. 5) and a lowered position (FIG. 4) to respectively lower and raise the sub-frame assembly 32. The lever 36 is pivotally connected to a first link 38 which is, in turn, pivotally connected to an upstanding lifting arm 40, which is pivotally connected to the sub-frame assembly by a second link 42, which is pivotally connected at its opposed end to a fixed cantilevered arm 44 projecting integrally rearwardly from the frame 12. It is understood that various linking systems and lifting mechanisms could be used for allowing the operator to move and maintain the sub-frame assembly 32 in its raised and lowered positions.

As best shown in FIGS. 4 and 5, the sub-frame assembly 32 carries a bottom press roll 46, a guide roll 48 and a multipoint burner 50. These elements are thus movable with the sub-frame assembly 32 for purposes that will be seen hereinafter. The press roll 46 is mounted at the rear end of the sub-frame assembly 32 for rotation about a central axis thereof. When the sub-frame assembly 32 is pivoted to its lowered position by operation of the control lever 36, the press roll 46 rides against the surface to which the membrane is to be applied. The multipoint burner 50 is inclined downwardly to heat the adhesive on the back surface of the bituminous membrane between the guide roll 48 and press roll 46 that is just before the membrane is pressed against the surface to be covered by the press roll 46 (see FIG. 5). The guide roll 48 is mounted at opposed end thereof to a pair of pivot arms 52 for pivotal movement between a functional position (FIG. 5) and an idle position (FIG. 4).

As shown in FIG. 5, the membrane applicator 10 further comprises a roll mount system 54 adapted to receive a roll of bituminous membrane M or other types of membrane. The bituminous membrane M is typically rolled on a hollow cylindrical cardboard core C. The roll mount system 54 generally comprises a pair of support rolls 56 mounted to a fixed portion of the frame 12 for free rotation about respective axes thereof. As shown in FIG. 5, the roll M rests on the support rolls 56. End guards 58, at least one of which is pivotable, (FIGS. 4 and 5) are provided for limiting axial movement of the roll M on the support rolls 56. The guards or one guard 58 can be pivoted to the position shown in FIG. 4 to permit easy longitudinal loading of the roll M on the support rolls 56. After, the roll M has been positioned on the support rolls 56, the guard(s) 58 is/are pivoted to the position shown in FIG. 5 to prevent longitudinal withdrawal of the roll M from the support rolls 56. As opposed to conventional roll mount systems which hold the roll M by the core thereof, the present roll mount system is not limited to one specific size and type of roll but can rather virtually accommodate all commercially available size and type of roofing membranes. Furthermore, each end of the roll M can advantageously be placed either on the right side or the left side of the membrane applicator 10. This may be advantageous when working with membranes having one longitudinal bonding side edges.

The applicator 10 further comprises a tension roll 60 mounted to a pivot arm 62 pivotally connected to the frame 12 for pivotal movement between an idle position (FIG. 4) and a functional position (FIG. 5) in which the tension roll presses the membrane M against an underlying transfer roll 64 mounted to the frame 12. The tension roll 60 is preferably fixedly mounted to the pivot arm 62. As shown in FIG. 4, the pivotable guard 58 is advantageously mounted to the pivot arm 62 with the tension roll 60.

A cardboard catcher 66 is provided between the transfer roll 64 and the support rolls 56 to prevent the core C from falling in front of the press roll 46 once the membrane M has been completely unrolled therefrom. According to embodiment of the present invention, the cardboard catcher 66 is provided in the form of a transversal plate coextensive with the rolls 56 and 64 but extending at a higher elevation than said rolls 56 and 64 to act as a stopper for the cylindrical cardboard core C.

Figure 3:
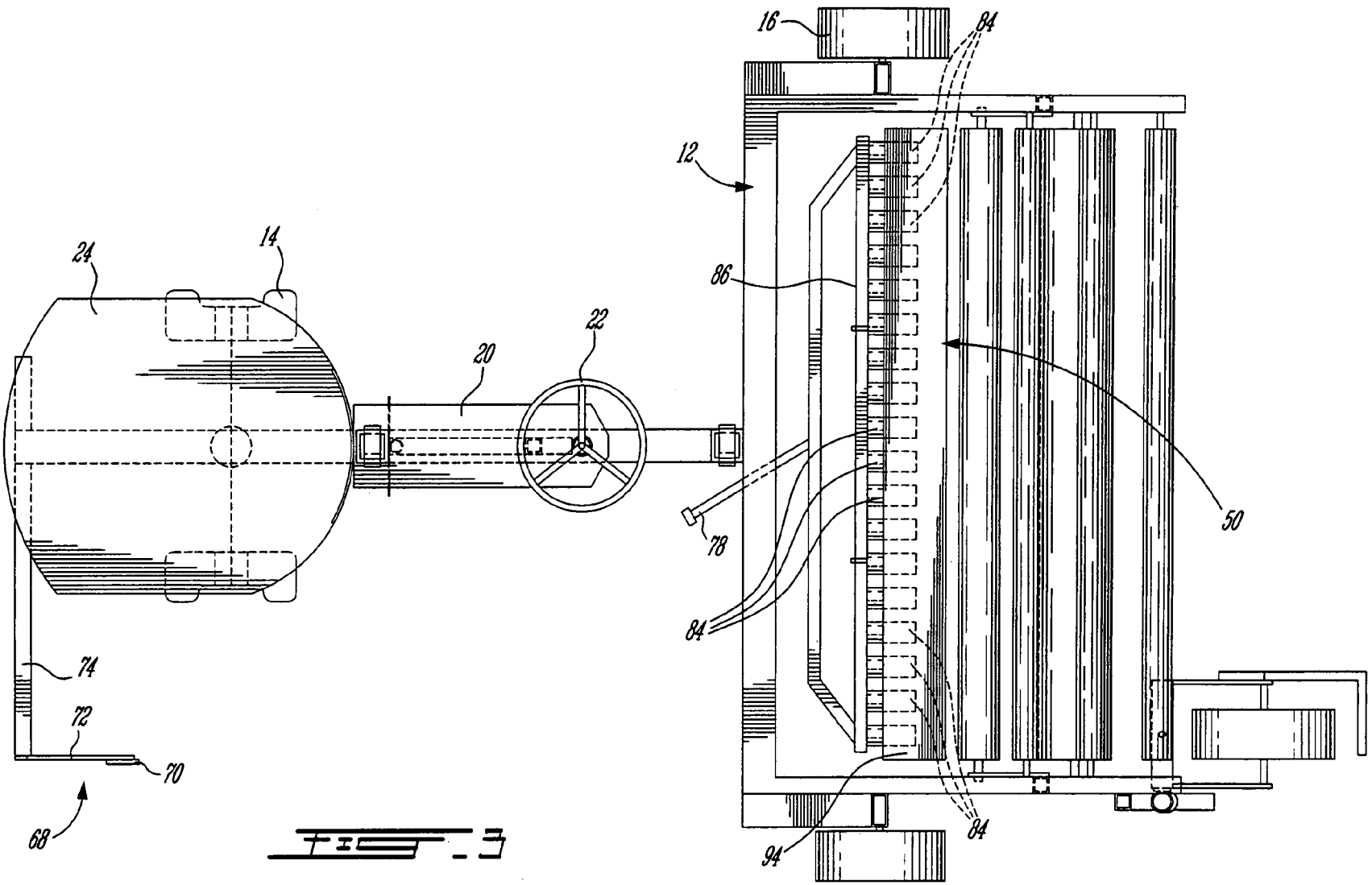
FIG. 3 is a top plan view of the membrane applicator.

As shown in FIGS. 2 and 3, the outer diameter of the guide roll 48 gradually decreases towards the center thereof to reach a minimum value midway between the opposed longitudinal ends of the roll where the diameter is at its maximum. This configuration of the guide roll 48 ensures that the membrane M be perfectly centered with respect to the applicator 10 while the applicator is displaced over the roof deck.

A visual alignment guide 68 is provided at one side of the applicator 10 to facilitate the alignment of the applicator 10 by the operator with the longitudinal side edges of a previously installed membrane or with the side of a deck surface to be covered with side-by-side membranes. By vertically aligning the alignment guide 68 over the adjacent longitudinal side of a previously installed membrane, the new membrane M loaded in the applicator 10 will be applied over the deck surface with a small overlap of one side edges thereof with the adjacent longitudinal side edges of the previously installed membrane. This thus provides for the formation of perfectly uniform lap joints along all the length of adjacent membranes. In this way, the impermeability of the overall deck covering can be significantly improved. The alignment guide 68 and the guide or centralizing roll 48 eliminate the needs of having recourse to two individuals for tending and properly aligning the membranes. In the past, this operation has been known to be physically demanding. The applicator 10 advantageously eliminates the physical efforts while ensuring a better precision in the formation of the longitudinal lap joints between the membranes.

According to the illustrated embodiment, the alignment guide 68 comprises a wheel 70 carried at the distal end of a rearwardly projecting inclined arm 72 mounted at the end of a transversal beam 74 extending laterally outwardly from one side of the frame 12 (see FIGS. 3 and 4). In use, the wheel 72 rides on the adjacent side of the previously installed membrane.

As best shown in FIG. 3, the multi-point burner 50 is adapted to heat the entire width of the roll of bituminous membrane M, thereby ensuring uniform fusion of the membrane M over the entire area of the deck. This is an important advantage over the standard hand-held torch method wherein an operator holds a torch in his hands and swept the torch across the back surface of the membrane M. The burner 50 generally comprises a propane feed pipe 78 connected in fluid flow communication with the propane tank (not shown) mounted on the frame 12 via a gas hose 80 (FIG. 5). A throttle lever 82 operatively connected to a valve is provided for allowing the operator to control the flow of propane to the burner 50. A pressure gauge (not shown) is preferably provided in a control box 83 (FIG. 4) for allowing the operator to adjust the pressure at which the propane is delivered to the multi-point burner 50.

Figure 6B:
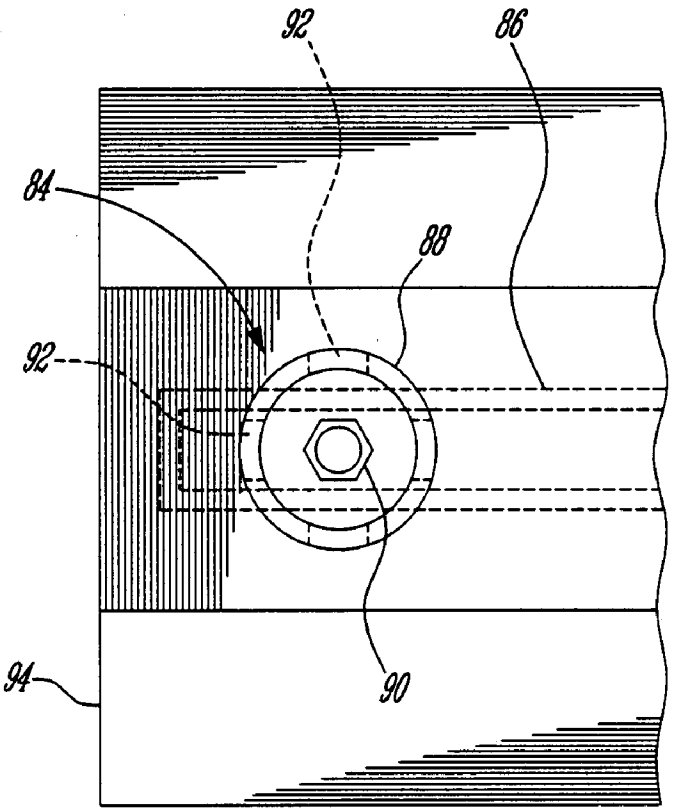
FIGS. 6A and 6B are enlarged side and front elevation views of a portion of the multi-point burner forming part of the membrane applicator.
Figure 6A:
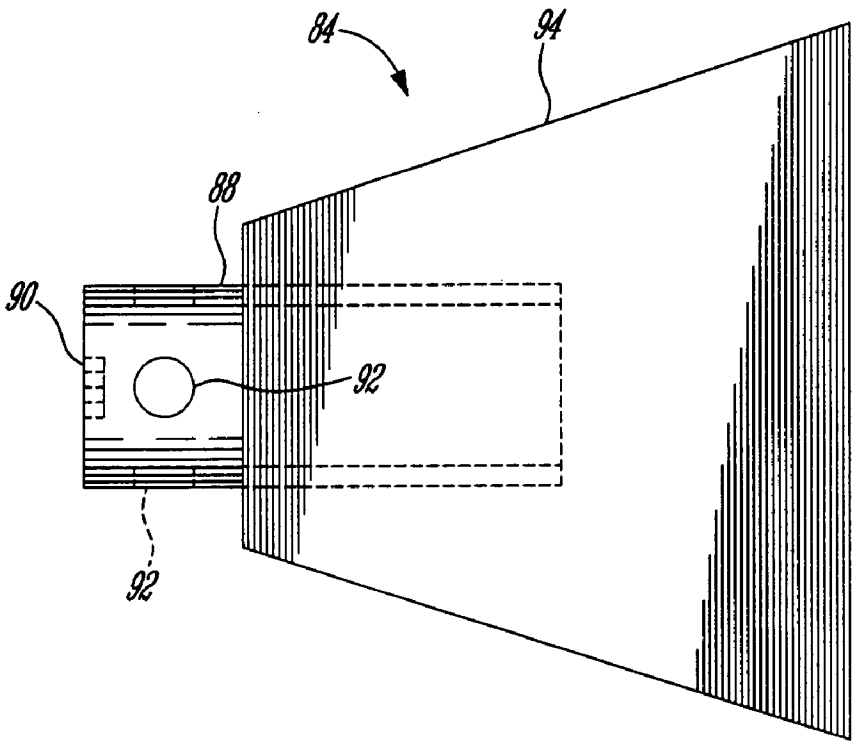

As shown in FIG. 3, the multi-point burner 50 comprises a plurality of BTU outlets 84 uniformly distributed along a common propane distribution pipe 86 extending along the entire width of the roll M. The pipe 86 is connected is fluid flow communication with the feed pipe 78. As shown in FIGS. 6*a* and 6*b*, each outlet 84 comprises a cylindrical sleeve 88 and a nozzle 90 mounted at the proximal end of the sleeve 88. It is noted that the nozzles 90 at the ends of the distribution pipe 86 have a larger discharged opening than the others because the longitudinal sides of the membrane needs more heat to ensure proper adherence thereof to the deck surface. A number of air holes 92 (four in the illustrated embodiment) are distributed about the cylindrical sleeve 88 near the nozzle 90. The holes 92 are sized and positioned to provide an optimum mixture of air and propane at the nozzle 90.

The front portion of the sleeves 88 is surrounded by a hood 94 to limit heat dissipation upstream of the membrane M. The air holes 92 are located outside the hood 94. As shown in FIG. 6 *a*, the hood 94 flares in a direction away from the nozzles 90 and the distribution pipe 86 to define a relatively large rectangular opening.

As shown in FIG. 4, an optional granule spreader 100 can be selectively removably installed on either side of the rear end of the frame 12. The granule distributor 100 generally comprises a hopper 102 and a press wheel 104 for pressing the granules dropped from the hopper 102 onto the excess bitumen squeezed out from the lap joint between adjacent membranes as a result of the pressure exerted onto the membrane M by the press roll 46. It is understood that in its functional position the spreader 100 is positioned slightly outwardly of the overlap between the membranes so as to be in vertical alignment with the excess melted bitumen seeping out laterally from between the membranes. A cable 106 is connected to an operating lever 108 for allowing the operator to actuate a valve 110 provided at the bottom of the hopper 102 from his standing position on the frame 12. The valve 110 is actuated by the lever 108 to vary the effective size of the opening at the bottom of the hopper 102 to thereby adjust the flow of granules falling down from the hopper 102. It is noted that wheel 104 is located slightly rearwardly of the drop of granules. A guide 112 may be provided to ensure that the granules fall just in front of the press wheel 104.

It is noted that the press wheel 104 can be used without the hopper 102 to further press the membrane along one side thereof to cause excess molten bitumen to seep out laterally from that one side of the membrane M.

As shown in FIG. 5, the spreader 100 is preferably pivotally mounted for rotation about an upstanding pin 114 slightly inclined from the vertical and extending from the rear end of frame 12. As a result, the spreader 100 moves vertically while being rotated about the post 114. The spreader is pivotable between a functional position in which the spreader 100 is axially aligned with the applicator 10 and in which the press wheel 104 is lowered against the membrane M that has just been laid down on the deck surface, and an idle position in which the spreader 100 has been pivoted laterally outwardly on a side of the frame 12 with the press wheel 104 raised at a distance above the laid down membrane M.

In use, the tension roll 60 together with guard 58 is pivoted to their idle position, as shown in FIG. 4. Then, the roll M is positioned onto the support rolls 56. The sub-frame 32 has preferably previously been moved to it raised position as shown in FIG. 4 in order to rise the press roll 46 above the deck surface to be covered. Also, the guide roll 48 is preferably pivoted to its idle position, as shown in FIG. 4 to permit easy placement of the membrane below the press roll 46. A length of membrane is unrolled from the roll M and drawn downwardly underneath the press roll 46. Then, the sub-frame 32 is pivoted to its lowered position by operation of lever 36 so as to lower the press roll 46 onto an underlying end portion of the membrane M, as shown in FIG. 5. The press roll 60 and the guide roll 48 are also pivoted to their functional position to engage opposed sides of the membrane as shown in FIG. 5. Thereafter, the burner 50 is lighted up to heat the adhesive on the back side of the membrane M and the carriage is propelled in the direction of arrow A in FIG. 5 in order to adhesively apply the membrane on the deck. The tension roll 60 maintains the membrane M under tension to prevent any slack in the membrane M on the deck. The operator can rely on the alignment guide 68 to ensure that the membrane is being applied along a straight line. If the membrane has a bituminous strip along one longitudinal side, the granulator 100 can be used to drop granules onto the excess melted bitumen seeping from the side of the membrane as the applicator 10 is advanced.

As opposed to the Red Dragon membrane applicator, which requires that the position of the heat source be readjusted during the operation to compensate for the reduction of the diameter of the roll of membrane, the distance between the heat source and the back side of the membrane M at the press roll 46 is constant irrespective of the diameter of the roll of membrane, thereby obviating the need to readjust the position of the heat source or recalibrate the BTU outputs thereof during use. This provides a significant advantage over the Red Dragon membrane applicator. Also, the use of a press roll 46 ensures that a constant pressure be applied on the membrane throughout the process irrespective of the size of the roll M.

The above description is meant to be exemplary only, and one skilled in the art will recognize that changes may be made to the embodiments described without department from the scope of the invention disclosed. For example, if the applicator is used to apply a membrane or a sheet material which does not need to be heated to adhere to the underlying surface, then the applicator can be provided without the burner 50. Also, it is understood that various types of heat source could be used to heat the adhesive on the membrane. Various types of fuel could be used in place of propane. Still other modifications which fall within the scope of the present invention will be apparent to those skilled in the art, in light of a review of this disclosure, and such modifications are intended to fall within the appended claims.

The invention claimed is:

1. An apparatus for applying a membrane to a substantially flat surface, the membrane having a front side and an adherent back side; the apparatus comprising a wheeled carriage adapted to ride on the surface to be covered with the membrane, a roll mount system provided on said carriage to support a roll of membrane on said carriage, a press roll mounted to said carriage and engageable with the front side of the membrane to press the back side thereof against the surface to be covered as the membrane is being unrolled from said roll mount system as a result of a displacement of said carriage on the surface, a guide roll having a straight axis is mounted to said carriage between said roll mount system and said press roll, said guide roll and said press roll being parallel, said guide roll having an outer diameter and longitudinally opposed first and second ends, said outer diameter gradually decreasing in a direction away from said first and second ends to reach a minimum at midway between said first and second ends, a heat source mounted to said carriage and heating the back side of the membrane between the guide roll and the press roll, and a tension roll pivotable between an idle position and an operational position wherein the roll applies a tension on the membrane downstream from the roll mount system relative to an advancement direction of the membrane through the apparatus, said tension roll pressing the membrane against a transfer roll mounted between the roll mount system and the press roll.

2. An apparatus as defined in claim 1, wherein a heat source is mounted to said carriage at a distance from said press roll to heat the back side of the membrane before the membrane is pressed against the surface to be covered by the press roll.

3. An apparatus as defined in claim 2, wherein said heat source comprises a burner adapted to heat the membrane on all the width thereof, and a fuel tank mounted to said carriage, said fuel tank being connected in fluid flow communication with said burner.

4. An apparatus as defined in claim 2, wherein said heat source comprises a burner connected to a fuel tank, said burner having a series of outlets distributed along a common distribution pipe, the distribution pipe being connected in fluid flow communication with the fuel tank to feed the outlets with fuel, and wherein each of said outlets comprises a nozzle mounted in a sleeve having at least one air hole defined therein.

5. An apparatus as defined in claim 4, wherein said sleeves are surrounded by a hood for concentrating heat on the membrane.

6. An apparatus as defined in claim 4, wherein said nozzles and said sleeves are inclined downwardly.

7. An apparatus as defined in claim 1, wherein said press roll is displaceable relative to said carriage between a raised position for allowing positioning of the membrane underneath said press roll and a lowered position wherein the press roll presses the membrane against the surface to be covered.

8. An apparatus as defined in claim 2, wherein said carriage includes a wheeled frame and a sub-frame mounted to said wheeled frame and displaceable with respect thereto between a lowered and a raised position, and wherein said heat source includes a burner, said press roll and said burner being mounted to said sub-frame.

9. An apparatus as defined in claim 1, wherein said guide roll is movable between an idle position in which the guide roll is out of a feed path of the membrane between the roll mount system and the press roll and a functional position wherein the guide roll extends to said path to engage the top side of the membrane as the membrane is being unrolled from the roll mount system.

10. An apparatus as defined in claim 1, wherein said tension roll, said transfer roll and said press roll cooperate to define a feed path for the membrane, and wherein said transfer roll and said press roll are located on a first side of said feed path whereas said tension roll is located on a second side of said feed path opposite said first side thereof.

11. An apparatus as defined in claim 1, wherein said roll mount system includes a pair of parallel support rolls laterally disposed relative to each other to provide a rotatable bottom seating surface adapted to receive thereon the roll of membrane.

12. An apparatus as defined in claim 11, wherein guards are provided at opposed longitudinal ends of said pair of support rolls to prevent longitudinal withdrawal of the roll of membrane from the support rolls, at least one of said guards being movable away from said opposed longitudinal ends to facilitate the positioning of the roll onto said support rolls.

13. An apparatus as defined in claim 1, further comprising a press wheel mounted on one side of the carriage rearwardly of said press roll with respect to a direction of travel of said carriage on the surface to be covered, the press wheel being positioned to further press a side edge portion of the membrane after the membrane has been pressed on all the width thereof against the surface by the press roll.

14. An apparatus as defined in claim 13, wherein the press wheel is selectively positionable on opposed sides of the carriage.

15. An apparatus as defined in claim 13, wherein the press wheel is movable from an operational position wherein an axle of the press wheel is parallel to a longitudinal axis of the press roll and an idle position wherein the press wheel is raised out of engagement with the membrane against the surface to be covered.

16. An apparatus as defined in claim 13, wherein a hopper containing granules is mounted to the carriage to drop granules just in front of the press wheel.

* * * * *